United States Patent [19]

Schmanski

[11] Patent Number: 4,511,281

[45] Date of Patent: Apr. 16, 1985

[54] ROAD-SURFACE MOUNTABLE DELINEATOR SUPPORT MEMBER

[75] Inventor: Donald W. Schmanski, Carson City, Nev.

[73] Assignee: Carsonite International Corporation, Carson City, Nev.

[21] Appl. No.: 311,350

[22] Filed: Oct. 14, 1981

[51] Int. Cl.[3] ..... E01F 9/01

[52] U.S. Cl. ..... 404/10

[58] Field of Search ..... 404/10, 9; 40/607, 608, 40/610; 52/98; 256/13.1; 116/63 R, 63 P, 63 C; 4/255

[56] References Cited

U.S. PATENT DOCUMENTS

| | | | |
|---|---|---|---|
| 1,337,947 | 4/1920 | O'Toole | 404/10 X |
| 1,802,940 | 4/1931 | Cornelius | 404/10 |
| 1,833,124 | 11/1931 | Rand | 404/10 |
| 2,529,576 | 11/1950 | Scanlon | 404/16 |
| 2,699,982 | 1/1955 | Batterson | 404/15 |
| 2,719,214 | 9/1955 | Potter | 404/10 X |
| 2,808,803 | 10/1957 | Weig | 404/10 X |
| 2,879,765 | 3/1959 | Featherston | 4/255 |
| 2,969,484 | 1/1961 | Suckow | 404/10 X |
| 3,709,112 | 1/1973 | Ebinger | 404/10 |
| 3,732,842 | 5/1973 | Vara | 404/10 X |
| 3,853,418 | 12/1974 | Druin | 404/10 X |
| 3,858,997 | 1/1975 | Boone | 404/10 |
| 3,987,593 | 10/1976 | Svensson | 404/10 X |
| 4,078,867 | 3/1978 | Ronden | 404/10 |
| 4,122,795 | 10/1978 | Doring | 404/10 X |
| 4,183,505 | 1/1980 | Maestri | 404/10 X |
| 4,269,534 | 5/1981 | Ryan | 404/10 |
| 4,341,488 | 7/1982 | Ryan | 404/10 |

FOREIGN PATENT DOCUMENTS

| | | | |
|---|---|---|---|
| 484028 | 6/1952 | Canada | 4/255 |
| 7608005 | 10/1976 | France | 404/10 |

*Primary Examiner*—William F. Pate, III

[57] ABSTRACT

A road-surface mountable delineator support member constructed of resilient wall structure of flexible material whose structure is capable of maintaining an attached delineator in upright, operational orientation as a traffic guide and capable of surviving repeated vehicle impacts. The wall structure is sectionally comprised of an integrally formed neck, shoulder and larger collapsible body in which most of the vehicle impact forces are transferred to the larger collapsible body section which deforms in preference to deformation of an attached delineator structure. The support base can be adhesively attached to a road surface and can be adapted for attachment of tubular delineator structures with various reflective format.

3 Claims, 9 Drawing Figures

ROAD-SURFACE MOUNTABLE DELINEATOR SUPPORT MEMBER

FIELD OF THE INVENTION

This invention relates to free-standing delineators useful for directing or channeling traffic and which are mounted on a road surface such as cement, asphalt, etc. More particularly, this invention pertains to a support member which is fixed at its base to the road surface and includes a neck or hub for attachment of an elongated delineator thereto. This combination is collapsible such that impact by a car would result in deformation and subsequent restoration to an original upright configuration.

PRIOR ART

Regulation of traffic flow presents a growing challenge with the ever-increasing number of vehicles and complexity of roadway systems. Numerous methods of traffic delineation have been developed to enhance the safety of traffic movement.

Such devices can generally be categorized by their placement location. For example, one class of highway delineator devices is designed for placement between the opposing lanes of traffic and must meet certain criteria based on the unique problems which arise because of this particular location and environment. Other traffic devices are designed to be positioned at the side of the road to mark the lateral bounds of the prepared road surface. Obviously, the different location for this class of delineators creates a unique design problem which results in a separate class of delineator products.

One distinguising feature arising from the different environments of these respective delineator products relates to their manner of installation. With respect to the "center line" products which divide the highway, emplacement involves embedding or adhesively affixing small reflector devices to the hard road surface. This is contrasted with the roadside delineators which are inserted into the ground to depths sufficient to stabilize the delineator in a safe and permanent orientation. Typically, these roadside delineators are sufficiently long to project approximately four to five feet above ground level and retain reflective means which operates during night hours to continue the delineation function.

The modern trend with respect to all such delineator devices is to develop structure which can withstand vehicle impact without requirement for corrective maintenance. In order to achieve this "survivability" characteristic, various flexible plastics have been utilized to structure the elongate body of the delineator.

A further class of delineators arises where an elongate delineator body is required to be placed directly on a hard road surface on a temporary or semi-permanent basis. In each instance, a typical structure includes a flexible tubular member comprising the elongated delineator portion, which has a reflective material or color thereon. This tube is mounted in a disc or base member which is weighted sufficiently to hold the delineator in upright orientation. When its use is intended to be for a short duration, the delineator may simply be set on the cement or pavement surface with no further means of fixation used. When emplaced for longer periods of time, the disc or base portion may be cemented to the road surface by epoxy glue or other appropriate adhesives. Such devices are particularly useful in controlling traffic lanes.

Although various types of flexibility mechanisms have been incorporated in the elongate delineator section of such devices, they all share the common mounting structure which comprises the previously referenced flat disc which has one side adapted for adhesive attachment to the road surface and the other side with some means for attachment of the elongate delineator. Such flat discs are not intended to substantially add to the flexible characteristic of the delineator, but merely form a means of fixation to the road surface.

The most significant problem inherent in this type of prior art structure arises because of the flexibility of the elongated delineator section. For example, as a vehicle impacts this delineator, the flexible body of the delineator wraps around the bumper and is subsequently pulled away from the mounting plate or base by the force of the vehicle. In those instances where the flexible delineator is able to recover from its collapsed position at the bumper of the automobile, the stress applied frequently tends to exceed the elastic limit of the plastic and eventually results in failure. It is apparent that the survivability of such a delineator structure depends upon the speed of the vehicle, the strength of the adhesive bond which holds the base section at the road surface, the method of attachment of the delineator body and the elasticity characteristics which enable the delineator to survive the impact. In summary, it is clear that the prior art has focused on developing a flexible delineator body to overcome these problems for surface-mountable delineators. Little attention has been given to technical improvement of the delineator base, despite the fact that it also represents a hazzard for motorcycles, due in part to its rigid structure.

OBJECTS AND SUMMARY OF THE INVENTION

It is therefore an object of the present invention to provide a surface-mountable, delineator support member which develops the desired flexibility and mechanical response to enable an attached delineator to survive impact by a vehicle.

It is a further object of this invention to provide a more rigid delineator body which is less prone to wrap around a vehicle bumper and thereby be subject to higher pulling stresses at the point of attachment to the road surface.

It is a still further object of this invention to provide a delineator support member which is capable of collapsing in response to vehicle impact by a non-destructive mechanism, and which then restores the delineator to an upright orientation.

An additional object of the present invention is to provide a delineator which is able to properly respond and survive vehicle impact from any lateral angle of attack.

A still further object of this invention is to provide a delineator support member which includes a programmed collapse mechanism designed to permit deflection of the elongate delineator body attached thereto out of the path of the impacting vehicle instead of collapse thereof at its bumper.

These and other objects are realized in a road-surface mountable, delineator support member which includes resilient wall structure comprised of a flexible material whose fabricated structure is capable of (i) maintaining an attached delineator in operational orientation as a traffic guide, and (ii) remaining serviceable despite occurrence of tension and compression forces transferred to its wall structure in consequence of a vehicle impact when attached at said delineator and said road surface. The wall structure of this support member is sectionally comprised of an integrally formed neck, shoulder and larger collapsible body. The neck and shoulder have a composition and geometric configuration which develops sufficient compressional stiffness based on elastic modulus in compression and compressional moment of inertia to maintain an attached delineator in operational orientation and to transfer most of the compressional forces into the larger collapsible body wall section.

The neck section has a compressional stiffness greater than the compressional stiffness of the body section and has a width and attachment means adapted for fixation of a delineator body at a top portion thereof. This compressional stiffness decreases through a shoulder section to the lesser compressional stiffness of the larger body section. This larger body section is substantially greater in size and width than the neck and shoulder sections and has a compressional stiffness which is substantially uniform at any given radius around its central axis.

The support member further comprises at least one opening to the interior of the wall structure to thereby permit rapid escape of contained air during collapse of the wall structure. Furthermore, this resilient wall structure has a thin cross section to permit the support member to collapse to a substantially flat structure under full compression. Finally, the support member further comprises a base member with means for attachment thereof to the road surface, the base member being attached at a lower rim of the body section.

In accordance with the present invention, collapse of the support member usually occurs prior to the deformation of the delineator body around the bumper of the impacting vehicle. Actual response will depend on bumper height and vehicle speed.

As a consequence of this collapse sequence, the delineator body is not subjected to such extreme stresses as occurred in prior art structures. Instead, the support member collapses at its body wall section and dissipates the impact energy over a broader surface. Stress within the support member wall structure is reduced by its folding action in the larger body structure, thereby reducing the stresses applied at the neck and shoulder section thereof.

By use of this inventive structure, a surprising and unusual improvement in delineator performance is obtained. This is particularly true where a more rigid delineator body can be used which is less likely to deform around the vehicle bumper and be pulled from its mounted position at the road surface. The relatively large structure of the body section provides the unexpected folding response thereof which permits complete collapse of the support member without damage. When formed of appropriate impact-resistant plastics, the support member then has the strength to upright the delineator and assume its original orientation.

Other objects and features of the subject invention will be apparent to those skilled in the art, in view of the following detailed description and accompanying drawings.

DETAILED DESCRIPTION OF THE INVENTION

Figure 1:
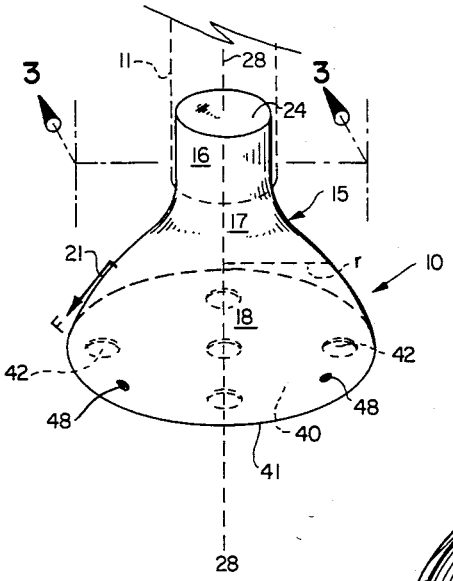
FIG. 1 represents a perspective view of one embodiment of the subject delineator support member. An attached delineator is represented in phantom line.

Referring now to the drawings:

An example of a road-surface mountable delineator support member is illustrated in FIG. 1, identified generally as 10. Both the material composition and geometric structure of the support member are so designed that its use in combination with a more rigid delineator body 11 develops a preference for collapse in the support member 10, rather than collapse and deformation of the delineator body 11 around the vehicle bumper or impacting surface. Generally speaking, this preferential collapsible character within the support member is developed by use of resilient plastics which concurrently have a flexural modulus sufficiently high to insure stiffness within the plastic wall structure necessary to retain the attached delineator 11 in a upright configuration, yet flexible enough to resist material failure during flexation in response to vehicle impact whose speeds may reach highway velocities.

It will be apparent to those skilled in the art that at higher speeds, the tensile strength of the referenced plastic material must be sufficiently high to survive extreme forces which are transmitted into the support member from the deflected delineator body. Where greater impact force is anticipated, impact resistant materials such as HYTRIL TM may be desirable. In traffic control lanes where reduced speed is anticipated, less expensive plastics such as vinyl modified polyethylenes having the necessary stiffness to support the attached delineator may be used.

It will be apparent to those skilled in the art that numerous plastics may be utilized to incorporate the principles of the subject invention in a road-surface mountable delineator support member. Furthermore, the description provided herein is intended to identify the important factors which must be satisfied in making a material selection from the variety of plastics available. Further classification of suitable polymers is therefore unnecessary, since those skilled in the art would have the required know-how to satisfy the requirements of (i) tensile strength, (ii) proper selection of flexural modulus and (iii) related structural parameters which will be apparent from the descriptive material provided hereafter.

Furthermore, other factors will affect the type of material composition selected. For example, the method of fabrication will be a determinative factor in selection of plastic materials. Although the recommended manufacturing process disclosed herein for HYTRIL may be by a rotational molding process, other methods of constructing the required geometrical configuration may prove equally acceptable. In addition, a variety of weather conditions and serviceability requirements may contribute to the final selection of material to be used in the subject delineator support member. It should therefore be understood, that specific composition formulas, physical parameters of such composition, and related technical information is available to those skilled in the art such that further explanation herein is unnecessary.

The primary novelty of the subject invention arises from the geometrical configuration utilized in combination with an appropriate structural material. This combination is used to develop a preferential mode of collapse which operates to dissipate impact energies to which the delineator 11 is subjected by transferring such energy into the support member 10 for dissipation by means of the referenced collapse mode. This geometric structure is generally represented in FIG. 1 by a resilient wall structure 15 whose configuration includes a neck section 16, a shoulder section 17, and a large body section 18 which are integrally formed as part of a single structure.

Figure 2:
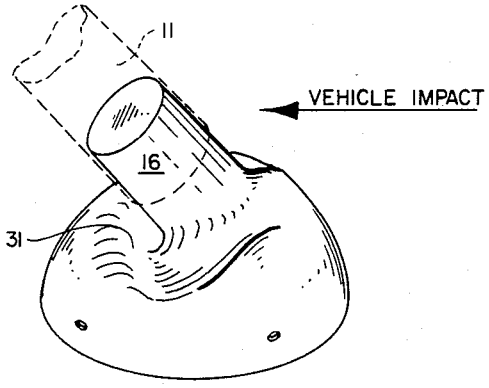
FIG. 2 shows the delineator of FIG. 1 in a collapsed configuration, responsive to a vehicle impact at the attached delineator body.

As indicated previously, this resilient wall structure is comprised of a flexible material which, when formed with the described integral neck, shoulder and larger collapsible body, is capable of (i) maintaining an attached delineator 11 in operational orientation as a traffic guide, and (ii) remaining serviceable despite occurrence of tension and compression forces transferred to the wall structure 15 in consequence of a vehicle impact. Since the subject support member is adapted with a preferential collapsing mode, the attached delineator should preferably be sufficiently rigid to resist extreme deformation over the vehicle bumper, but should instead deform out of the path of the vehicle as illustrated in FIG. 2. This rigid delineator structure provides for transfer of the impact energy into the support member to thereby facilitate the preferential collapse of the support member vis-a-vis the delineator. Here again, the actual selection of the delineator body will vary, depending upon the selection factors previously mentioned for the support member. If, for example, a tubular delineator is utilized, its rigidity may be adjusted by tube wall thickness, material stiffness or reinforcement structure along the tube length. An example of a stiff, impact resistant material suitable for a delineator body includes LEXAN, a commercially available polymer. An example of a suitable soft impact resistant material would be EVA.

Figure 5:
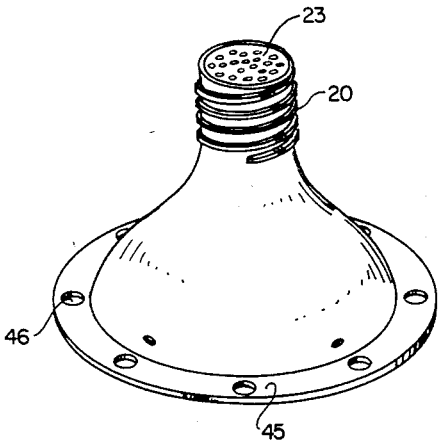
FIG. 5 illustrates alternative structure for the subject support member including a threaded neck and flanged base section.

As previously indicated, the wall structure is integrally formed with neck 16, shoulder 17 and larger collapsible body 18 sections. The primary function of the neck section 16 is to provide a somewhat rigid point of attachment for the delineator body 11 to be supported by the support member. Therefore, the exterior of the neck section 16 may be smooth to provide a friction fit which is suitable for temporary attachment or for permanent attachment by use of adhesives to bond the interior delineator surface to the neck section 16. FIG. 5 illustrates a threaded neck section which provides for temporary attachment of a correspondingly threaded delineator member. It will be apparent to those skilled in the art that numerous configurations can be adapted at the neck section to facilitate attachment of the upright delineator body.

Since the neck section constitutes an extension of the attached delineator body 11, its rigidity must be sufficiently high to prevent its collapse during impact of the delineator body 11 by a vehicle (see FIG. 2).

The desired rigidity in the neck section, as well as other parts of the wall structure for the support member are described hereinafter in terms of "compressional stiffness." This term has general reference to the resistance of the wall structure 15 to fold or buckle in response to forces which are transferred to the support member from the attached delineator body 11. In most cases, these forces will be applied along tangential orientations 21 over the resilient wall structure. In general terms, therefore, the meaning of "compressional stiffness" will refer to the physical properties within the wall structure 15 which enable the various parts (neck, shoulder and larger body) to maintain their static or noncollapsed configuration. This is the configuration illustrated in FIG. 1. As will be noted later, this static, rigid structure is designed to collapse as illustrated in FIG. 2, in which circumstances the compressional stiffness of the wall structure operates to restore the support member to its static configuration with the delineator 11 in an upright, operational orientation.

It should be noted from the description and drawings herein that compressional stiffness can be developed by appropriate composition of matter and proper geometric structure. The arcuate contours and domed structure illustrated in FIG. 1 increase the resistance to collapse or compressional stiffness of the support member. Following collapse as illustrated in FIG. 2, the resilience of the material and geometric configuration of its structure operate to restore the delineator 11 to an upright orientation.

The specific design parameters utilized to select an acceptable geometric configuration would naturally be coordinated with the material composition used. Based on application of the inventive principles disclosed herein, it is well within the ability of one skilled in the art to balance the flexibility characteristic of the material (as represented by the elastic modulus in compression) and the proper geometric configuration represented by its moment of inertia taken at a cross section corresponding to the direction of compressional force (referred to herein as compressional moment of inertia), to insure that during static, nonimpacting conditions the support member is rigid and establishes the attached delineator in upright orientation. These same parameters must also be balanced to insure that during impact, flexibility within the support member is properly developed such that impact forces are transferred from the delineator through the neck section of the support member and into the shoulder and larger collapsible body 18.

Figure 3:
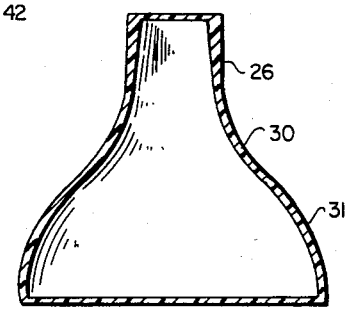
FIG. 3 shows a cross section of the structure in FIG. 1, taken along the lines 3—3.
Figure 4:
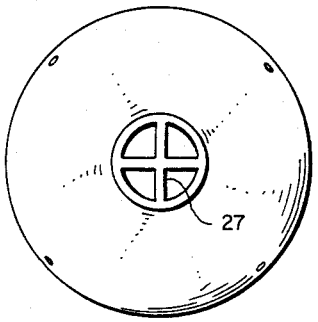
FIG. 4 shows an alternative reinforcement structure within the neck of the subject support member.

As represented in the figures, the compressional stiffness of the neck section 16 is higher than the remaining wall structure because of the reduced diameter and corresponding curvature. In addition, the neck section 16 is formed with a cap 24 which further stabilizes the wall section within the neck 16 to its normal static configuration. FIGS. 3 and 4 represent other methods of increasing the compressional stiffness within the neck section 16. In FIG. 3, the wall structure 26 of the neck section is increased in thickness. This increase in moment of inertia causes a corresponding increase in the compressional stiffness within this neck section of the support member. In similar manner, the reinforcing web component 27 shown in FIG. 4 develops an increased compressional moment of inertia to increase the resistance of the next section against collapse.

The next section of the collapsible support member is the shoulder section 17. Generally speaking, the shoulder section is that region between the neck section 16 and the larger collapsible body section 18 where the compressional stiffness begins to attenuate to match the compressional stiffness of the larger body section 18. In FIG. 1, this is accomplished by the shoulder section having an increasing width tapering radially away from the neck section 16 based on reference to the central axis 28 of the support member. Although the exact extremities of the shoulder section need not be exactly located, it is apparent that the compressional stiffness at the upper side of the shoulder section will be substantially equivalent to the stiffness of the neck section to which it is integrally joined. This compressional stiffness decreases in accordance with the tapering structure thereof to the lesser compressional stiffness of the larger body section 18.

As illustrated in FIG. 3, the compressional stiffness of the support member through the neck, shoulder and larger body section may be further adjusted by decreasing the wall thickness 26 to a lesser wall thickness 30 in the shoulder region of the support member, and finally to a thinner wall section 31 in the large, more flexible body section of the support member.

A primary feature of the inventive structure disclosed herein is the preference of the larger body structure 18 to collapse in advance of failure of the neck and shoulder sections 16 and 17.

To facilitate the preferential collapse of the larger body section 18, its structure is substantially greater is size and width than that of the neck and shoulder sections. As illustrated in the figures, this larger structure operates to decrease the compressional moment of inertia along any side of the support member which will be subject to the compressional forces transferred through the neck and shoulder sections.

A further benefit of the larger structure in the body section 18 arises from the increased area available for dissipation of the impact forces received therein. For example, FIG. 2 illustrates a broad pattern of deformation 31 which minimizes local stress and enables the delineator support member to transmit the sharp, abrupt impact of the vehicle into "wave-like" reaction within the larger body wall structure. This dissipation of energy is represented by the folding configuration represented within the body structure illustrated in FIG. 2.

Although not essential in implementing the general aspects of the subject invention, the preferred embodiment of the delineator support member would be operational against any direction of impact, throughout a 350 degree orientation with respect to the central axis 28. This characteristic may be realized by constructing the body section 18 with a compressional stiffness which is substantially uniform at any given radius around the central axis 28. This structure tends to develop a uniform and predictable response regardless of the impact direction. In most cases, a symmetrical geometric configuration would be desirable as illustrated in the accompanying figures, wherein the general structure of the support member is marked by an absence of sharp edges or other wall structure which would favor a crimping fold as opposed to a more desirable buckling fold which dissipates the compression energy over a larger surface area of the body section.

Figure 6:
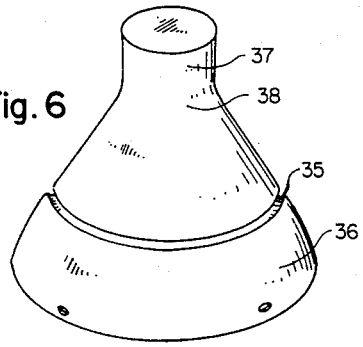
FIG. 6 illustrates a programmed collapse radius preformed into the support member wall structure.

It should be noted, however, that in certain circumstances where the traffic conditions are more predictable and with lower velocities, a circumferential crease 35 (FIG. 6) may be utilized to insure collapse of the larger body section in a specific pattern. The operation of the referenced crease would develop a preferred collapse situs thereat. With this configuration, the reduced compressional stiffness at the localized crease 35 within the larger body section 36 would decrease the value of compressional stiffness required in the neck section 37 and shoulder section 38 of the support member illustrated in FIG. 6.

In addition to the wall structure of the subject delineator support member, means are provided for attachment of the support member to the road surface. This attachment means is referred to herein as the base member 40 in FIG. 1 which is attached at a lower rim 41 of the body section 18. This base member 40 includes openings 42 which operate as part of the means to fix the base to the road surface. For example, an epoxy adhesive may be applied at the exposed surface of the base member 40 in sufficient thickness such that when applied to the road surface, the epoxy seeps through the holes 42, forming a type of retainer button which insures retention of the support member at the road surface, despite vehicle impact.

It should be noted that this base member may also be configured as an external flange member 45 (FIG. 5) which can likewise be adhesively fixed to the road surface. In this case, openings 46 represent the means for formation of the epoxy retaining button configuration. Other variations of the base member will be apparent to those skilled in the art.

In view of the fact that the preferred embodiment of the subject support member represents an enclosing structure sealed at its base to the road surface and capped at its neck to develop improved stiffness, holes 48 are provided within the large body wall to permit rapid escape of trapped air within the support member as it collapses into the configuration of FIG. 2, likewise in attempting to restore itself to its original static configuration of FIG. 1, the holes 48 provide access for air to return to the interior of the structure. Where the neck 16 may be left open with other stiffening reinforcement structure being used, such holes may be unnecessary.

The preferred embodiment of the subject support member should be capable of collapse to a substantially flat structure under full compression such as may occur by a direct tire impact over a portion of the support member body. In view of this, the general wall structure of the support member should be thin in cross section rather than of a bulky configuration. For example, the delineator illustrated in FIGS. 1 and 2 has a wall structure diameter of approximately $\frac{1}{8}$ inch with a material composition of HYTRIL TM . In this case, the delineator body has a uniform wall thickness throughout, with the increased compressional stiffness in the neck and shoulder being developed by the smaller radius and use of the cap section 24.

Consequently, when subject to impact, this delineator experiences an initial collapse of the large body section 18 as illustrated in FIG. 2, prior to any substantial failure in the neck and shoulder sections. Experimental tests have confirmed that this collapse mode operates best when the subject support member has a symmetrical configuration which forms a circular perimeter about the central axis 28, at any given radius r of the body section. For example, if the body section is elongated laterally into an eleptical configuration the structure is substantially less effective in deforming and dissipating the impact energy. It is also preferential that the large body section 18 of the resilient wall structure be convex from its exterior perspective and taper upward through a concave shoulder section as viewed in cross section along the central axis of the support member such as illustrated in FIG. 3.

One of the benefits of use of a larger convex surface as illustrated for the large body section 18 is an initial resistance to collapse which converts to a flexible structure once the threshold resistance is overcome. This shift in flexibility is represented by FIGS. 1 and 2. Initially, the compressional moment of inertia within the large body section 18 provides substantial support to maintain the delineator in a static operational mode. The convex configuration operates somewhat like an arch to dissipate compression forces initially throughout the domed large body structure.

Once, however, the domed structure collapses, the reduced moment of inertia and "arch effect" is lost, making the support member very flexible and readily subject to collapse. In this sense, the compressional moment of inertia developed during a noncollapsed state of the support member is substantially greater than the compressional moment of inertia following an initial collapse in the geometry of the larger body section.

Figure 7:
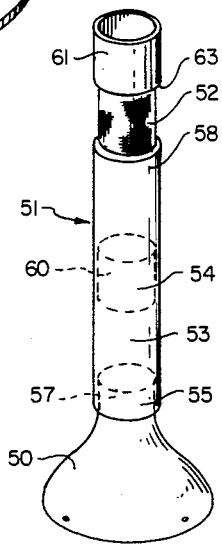
FIG. 7 illustrates the subject support member utilized in combination with segmented delineator structure.

FIG. 7 illustrates the subject support member 50 in combination with a delineator body 51 having a reflective exterior 52. The illustrated delineator body 51 is segmented to provide for attachment of multiple segments to establish a delineator length as may be required. In the illustrated FIG. 7, two segments are shown. The lower segment 53 has opposing female ends which permit insertion of the neck section 57 of the support member 50, as well as insertion of a second delineator segment 58 having a male end 60 and female end 61. Additional segments would have this same configuration to permit multiple stacking of delineator segments. Other traffic guide means may be substituted for the reflective material 52 shown on the subject delineator body. In view of the anticipated impact of this delineator with a vehicle bumper, it may be desirable to form the traffic guide means within a recessed section 63 of the delineator segment 58.

Figure 8:
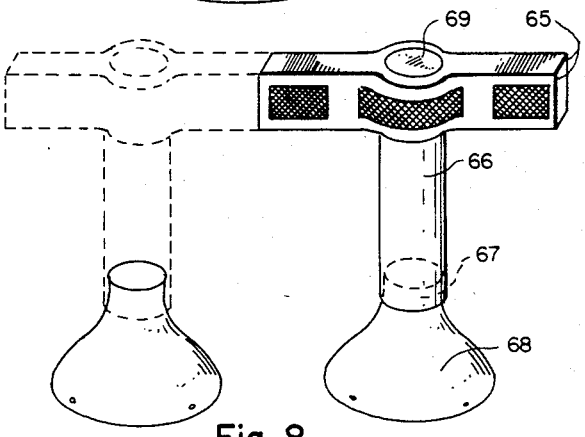
FIG. 8 depicts a horizontal delineator body as part of the subject invention.

In addition to the tubular delineator structures represented by FIG. 7, horizontal delineator structures may be used in combination with the subject support member. FIG. 8 discloses an elongated horizontal reflecting member 65 which is coupled to a delineator segment 66 mounted at the neck 67 of a delineator support member 68. The subject horizontal reflecting member 65 may also include a recess 69 to permit multiple stacking of additional delineator segments or horizontal reflecting members.

These various combinations of delineator structures are made possible because of the unique support capability of the subject support member and its ability to withstand vehicle impact. As indicated earlier, the design of the delineator bodies to be attached at the support member should include evaluation of rigidity to insure that the anticipated impact causes collapse of the support member in preference to collapse of the delineator body. Failure to make the delineator body sufficiently stiff would result in the adverse consequence experienced in the prior art where the flexible delineator body wraps around the bumper of the impacting vehicle, without permitting transfer of the impact energy into its support member.

The subject delineator/support member combination may be coupled to a second delineator/support member combination as illustrated in phantom line in FIG. 8 to develop a barricade reflector assembly. This barricade could be permanently afixed to a road surface in accordance with methods outlined herein, or it may be used as a temporary barricade by weighting the support members with sand or other comparable means. Likewise, the use of additional weight loaded in the base of the support member may be applied to delineator combinations such as illustrated in FIG. 7, where traffic conditions are appropriate.

Figure 9:
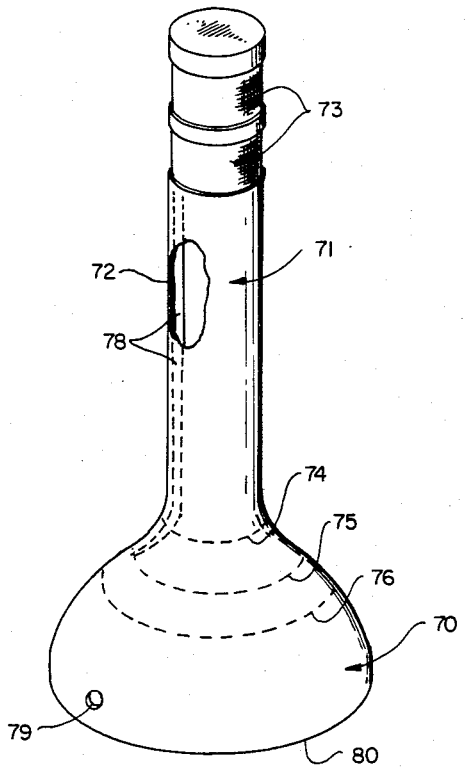
FIG. 9 depicts an integral delineator body and support member.

A further embodiment of the subject invention is illustrated in FIG. 9, wherein the support member 70 and delineator body 71 are integrally formed as a single unit. As illustrated, the delineator body comprises a tubular walled structure, illustrated by the cut away section 72. This tubular wall extends the full length of the delineator and support member combination. The length of the delineator body 71 is sufficient to place attached reflective material 73 at an elevation above the road surface to provide the desired delineation. In other words, the length of the delineator must be sufficient to provide an acceptable surface height for mounting reflective material 73 at the top thereof.

Inasmuch as the delineator depicted in FIG. 9 constitutes a single integral body, the elements of the support member do not have a clear line of demarcation. Nevertheless, the general areas are reflected by phantom perimeter lines along the support member wherein line 74 represents the general area of the neck section, line 75 represents the shoulder region of the support member and line 76 shows the location of the larger body section.

Where the subject delineator is rotational molded or formed by other means in which the wall structure of the delineator body 71 and support member 70 is of the same material, additional reinforcement may be required to develop preferential collapse in the larger body section 76 of the support member. Such additional support can be accomplished by the use of rib structure 78 which is attached longitudinally along the tubular wall structure 72 of the delineator body. When higher speed impact zones are contemplated for the subject delineator, the rib structure may be extended from the tubular wall section of the delineator into the wall structure of the support member. Such rib structure should be reduced or eliminated at the large body section to preserve collapsibility thereat.

As with the previous description of the support member having reinforcement of foam material (see FIG. 5, item 23) a moderately stiff foam insert can be utilized within the delineator body which operates to fill a sufficient length of the tubular body 71 to enhance the resistance against collapse of the delineator upon impact. As indicated previously, this is important so that preferential collapse of the large body section of the support member occurs prior to substantial deformation of the delineator 71. Additional support can be provided to the neck 74 and shoulder 75 sections of the delineator by extending the foam insert material into those regions. Such extension may extend to the base section; however, it should radially terminate wall contact above the large body section, leaving a substantial annular void space at the large body section to again permit preferential collapse thereat.

The support member 70 includes a ventilation opening 79 and means for attachment at the base 80 of the support member as previously described.

It is to be understood that the disclosure set forth herein is merely exemplary of the inventive subject matter expressly claimed hereafter. Accordingly, the scope of the invention is not to be limited beyond the invention definition provided in the following claims.

I claim:

1. A resilient, road-surface mountable delineator adapted for use with traffic moving at moderate speeds, said delineator being comprised of an integrally formed tube structure and support base;

said tube structure having a composition (represented by modulus of elasticity) and geometric configuration which develop greater stiffness in the tube structure as compared to stiffness in the support base to thereby create a preferential mode of collapse in response to a vehicle imnpact wherein the support base is adapted to collapse and dissipate impact energy by formation of wave-like contortions within support base wall structure in preference to total collapse of the tube structure, thereby avoiding deformation of the tube structure over an impacting surface such as a vehicle bumper;

said support base being sectionally comprised of integrally formed neck, shoulder and larger collapsible body sections, said neck and shoulder sections having a composition and geometric configuration which develops sufficient compressional stiffness based on elastic modulus in compression and compressional moment of inertia to maintain the attached delineator in operational orientation and to transfer most of said compression forces into the larger, collapsible body wall section; and said neck and shoulder sections of the support base further comprising a solidified foam insert retained within the neck and shoulder sections.

2. A resilient, road-surface mountable delineator adapted for use with traffic moving at moderate speeds, said delineator being comprised of an integrally formed tube structure and support base;

said tube structure having a composition (represented by modulus of elasticity) and geometric configuration which develop greater stiffness in the tube structure as compared to stiffness in the support base to thereby create a preferential mode of collapse in response to a vehicle imnpact wherein the support base is adapted to collapse and dissipate impact energy by formation of wave-like contortions within support base wall structure in preference to total collapse of the tube structure, thereby avoiding deformation of the tube structure over an impacting surface such as a vehicle bumper;

said support base being sectionally comprised of integrally formed neck, shoulder and larger collapsible body sections, said neck and shoulder sections having a composition and geometric configuration which develops sufficient compressional stiffness based on elastic modulus in compression and compressional moment of inertia to maintain the attached delineator in operational orientation and to transfer most of said compression forces into the larger, collapsible body wall section; and said tubular structure further including reinforcing rib structure attached longitudinally along the tubular wall, said rib structure extending along an interior surface of the tubular structure into the wall structure of the support base, said rib structure being reduced at the collapsible body wall section of the support base.

3. A resilient, road-surface mountable delineator adapted for use with traffic moving at moderate speeds, said delineator being comprised of an integrally formed tube structure and support base;

said tube structure having a composition (represented by modulus of elasticity) and geometric configuration which develop greater stiffness in the tube structure as compared to stiffness in the support base to thereby create a preferential mode of collapse in response to a vehicle imnpact wherein the support base is adapted to collapse and dissipate impact energy by formation of wave-like contortions within support base wall structure in preference to total collapse of the tube structure, thereby avoiding deformation of the tube structure over an impacting surface such as a vehicle bumper;

said support base being sectionally comprised of integrally formed neck, shoulder and larger collapsible body sections, said neck and shoulder sections having a composition and geometric configuration which develops sufficient compressional stiffness based on elastic modulus in compression and compressional moment of inertia to maintain the attached delineator in operational orientation and to transfer most of said compression forces into the larger, collapsible body wall section; and said greater stiffness in the tube structure being developed by addition of reinforcing structure at the tube structure walls comprising a moderately stiff foam insert which fills a sufficient length of the tubular structure to further increase resistance against collapse thereof upon impact, thereby retaining the preferential collapse of the large body section of the support base.

* * * * *